US011832362B2

(12) United States Patent
Tang

(10) Patent No.: US 11,832,362 B2
(45) Date of Patent: Nov. 28, 2023

(54) BACKLIGHT DRIVING CIRCUIT AND DISPLAY DEVICE

(71) Applicant: SHENZHEN CHINA STAR OPTOELECTRONICS SEMICONDUCTOR DISPLAY TECHNOLOGY CO., LTD., Shenzhen (CN)

(72) Inventor: Shijiong Tang, Shenzhen (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 264 days.

(21) Appl. No.: 17/057,644

(22) PCT Filed: Sep. 21, 2020

(86) PCT No.: PCT/CN2020/116443
§ 371 (c)(1),
(2) Date: Nov. 21, 2020

(87) PCT Pub. No.: WO2022/027803
PCT Pub. Date: Feb. 10, 2022

(65) Prior Publication Data

US 2022/0312567 A1 Sep. 29, 2022

(30) Foreign Application Priority Data

Aug. 5, 2020 (CN) ..... 202010777435.2

(51) Int. Cl.
*H05B 45/50* (2022.01)
*H05B 45/14* (2020.01)
*H05B 45/46* (2020.01)

(52) U.S. Cl.
CPC ..... *H05B 45/50* (2020.01); *H05B 45/14* (2020.01); *H05B 45/46* (2020.01)

(58) Field of Classification Search
CPC ..... H05B 45/10; H05B 45/14; H05B 45/24; H05B 45/30; H05B 45/34; H05B 45/46; H05B 45/50; H05B 47/10; H05B 47/20
See application file for complete search history.

(56) References Cited

U.S. PATENT DOCUMENTS

2008/0111800 A1* 5/2008 Wang ..... G09G 3/3406 345/204
2009/0295776 A1 12/2009 Yu et al.
(Continued)

FOREIGN PATENT DOCUMENTS

CN 101013559 A 8/2007
CN 101917809 A 12/2010
(Continued)

OTHER PUBLICATIONS

International Search Report in International application No. PCT/CN2020/116443, dated May 7, 2021.
(Continued)

*Primary Examiner* — Jimmy T Vu
(74) *Attorney, Agent, or Firm* — PV IP PC; Wei Te Chung; Zhigang Ma

(57) ABSTRACT

The present disclosure discloses a backlight driving circuit and a display device. The backlight driving circuit includes a power supply chip, light-emitting diodes connected to the power supply chip, and a voltage protection sub-circuit connected to both the light-emitting diodes and the power supply chip. By adding the voltage protection sub-circuit, when a negative terminal voltage of the light-emitting diode is abnormal, the voltage protection sub-circuit will output a feedback signal to the power supply chip to stop the power
(Continued)

supply chip from working, thereby improving reliability of the backlight driving circuit.

14 Claims, 5 Drawing Sheets

(56) References Cited

U.S. PATENT DOCUMENTS

| | | | | |
|---|---|---|---|---|
| 2010/0141163 | A1* | 6/2010 | Ye | H05B 45/38 315/189 |
| 2013/0147361 | A1* | 6/2013 | Kang | H05B 47/24 315/122 |

FOREIGN PATENT DOCUMENTS

| | | | |
|---|---|---|---|
| CN | 102568390 | A | 7/2012 |
| CN | 103021343 | A | 4/2013 |
| CN | 103021346 | A | 4/2013 |
| CN | 103198809 | A | 7/2013 |
| CN | 103295537 | A | 9/2013 |
| CN | 103354086 | A | 10/2013 |
| CN | 203522119 | U | 4/2014 |
| CN | 106710532 | A | 5/2017 |
| CN | 106910474 | A | 6/2017 |
| CN | 109272949 | A | 1/2019 |
| KR | 20090095135 | A | 9/2009 |

OTHER PUBLICATIONS

Written Opinion of the International Searching Authority in International application No. PCT/CN2020/116443, dated May 7, 2021.
Chinese Office Action issued in corresponding Chinese Patent Application No. 202010777435.2 dated Apr. 27, 2021, pp. 1-9.

* cited by examiner

BACKLIGHT DRIVING CIRCUIT AND DISPLAY DEVICE

RELATED APPLICATIONS

This application is a Notional Phase of PCT Patent Application No. PCT/CN2020/116443 having international filing date of Sep. 21, 2020, which claims the benefit of priority of Chinese Patent Application No. 202010777435.2 filed on Aug. 5, 2020. The contents of the above applications are all incorporated by reference as if fully set forth herein in their entirety.

FIELD OF INVENTION

The present disclosure relates to the field of display technology, specifically to a backlight driving circuit and a display device.

BACKGROUND OF INVENTION

With continuous advancement of technology, backlight technology of liquid crystal display devices has been continuously developed. A backlight of a traditional liquid crystal display device uses cold cathode fluorescent lamps. However, due to disadvantages of the cold cathode fluorescent lamp backlight such as poor color reproduction, low luminous efficiency, high discharge voltage, poor discharge characteristics at low temperatures, and long time required for heating to reach a stable gray scale, backlight technology using light-emitting diodes has been developed currently.

In a light-emitting diode backlight, a special backlight driving circuit is required to provide a driving voltage for a light-emitting diode string to normally emit light. However, the existing backlight driving circuit does not have a module for detecting a negative terminal voltage of the light-emitting diode. Therefore, when the negative terminal voltage of the light-emitting diode is abnormal, a temperature of a triode in a dimming module for adjusting brightness of the light-emitting diode will rise, which affects reliability of the backlight driving circuit.

Therefore, how to prevent the occurrence of a phenomenon that the reliability of the backlight driving circuit is affected by the abnormality of the negative terminal voltage of the light emitting diode is a difficult problem that panel manufacturers all over the world are trying to overcome.

Technical Problem

Embodiments of the present disclosure provide a backlight driving circuit and a display device, which can solve the technical problem that the reliability of the backlight driving circuit is affected by the abnormality of the negative terminal voltage of the light emitting diode.

SUMMARY OF INVENTION the present disclosure provides a backlight driving circuit, comprising:

A backlight driving sub-circuit, comprising a power supply chip and a plurality of light-emitting diodes connected to the power supply chip, wherein the power supply chip is configured to provide working voltages to each of the plurality of light-emitting diodes;

A voltage protection sub-circuit connected to the plurality of light-emitting diodes and the power supply chip, wherein the voltage protection sub-circuit is configured to output a feedback signal to the power supply chip to stop the power supply chip from working when an output of the plurality of light-emitting diodes is detected to be abnormal.

In the backlight driving circuit provided in the embodiment of the present disclosure, the voltage protection sub-circuit comprises a voltage detection module, a voltage comparison module, and a voltage processing module, wherein, The voltage detection module is connected to the plurality of light-emitting diodes and the voltage comparison module, and the voltage detection module is configured to filter out the highest negative terminal voltage among the negative terminal voltages output by the plurality of light-emitting diodes, and to output the highest negative terminal voltage among the negative terminal voltages output by the plurality of light-emitting diodes to the voltage comparison module;

The voltage comparison module is connected to the voltage detection module and the voltage processing module, and the voltage comparison module is configured to compare the highest negative terminal voltage among the negative terminal voltages output by the plurality of light-emitting diodes with a preset voltage, and to output an abnormal signal to the voltage processing module when the highest negative terminal voltage among the negative terminal voltages output by the plurality of light-emitting diodes is greater than the preset voltage; and The voltage processing module is connected to the voltage comparison module and the power supply chip, and the voltage processing module is configured to output the feedback signal to the power supply chip according to the abnormal signal, in order to stop the power supply chip from working.

In the backlight driving circuit provided in the embodiment of the present disclosure, the voltage detection module comprises a plurality of diodes, anodes of the plurality of diodes are respectively connected to negative terminals of the plurality of light-emitting diodes in a one-to-one correspondence, and cathodes of the plurality of diodes are connected together and connected to an input terminal of the voltage comparison module.

In the backlight driving circuit provided in the embodiment of the present disclosure, the voltage comparison module comprises a comparator, a first input terminal of the comparator is connected to an output terminal of the voltage detection module, a second input terminal is connected with a preset voltage signal, and an output terminal of the comparator is connected to an input terminal of the voltage processing module.

In the backlight driving circuit provided in the embodiment of the present disclosure, a voltage of the preset voltage signal ranges from 3V to 6V.

In the backlight driving circuit provided in the embodiment of the present disclosure, the voltage processing module comprises a first resistor, a second resistor, a third resistor, a first triode, a second triode, and a voltage output unit, wherein, One terminal of the first resistor is connected to a collector of the second triode and an output terminal of the voltage comparison module, and the other terminal of the first resistor is connected to a base of the first triode;

One terminal of the second resistor is connected to an emitter of the second triode and the voltage output unit, the other terminal of the second resistor is connected to one terminal of the third resistor and a base of the second triode, and the other terminal of the third resistor is connected to a collector of the first triode and an input terminal of the power supply chip; and An emitter of the first triode is grounded.

In the backlight driving circuit provided in the embodiment of the present disclosure, when the voltage processing module receives the abnormal signal output by the voltage comparison module, the first triode is turned on;

A current flowing through the base of the second triode increases, and the second triode is turned on;

A voltage output by the voltage output unit is applied to the base of the first triode, the first triode is further turned on, and both the first triode and the second triode reach saturation conduction status; and The collector of the first triode maintains the state of outputting a low level to the power supply chip, so that the power supply chip stops working.

In the backlight driving circuit provided in the embodiment of the present disclosure, the backlight driving circuit further comprises a dimming control sub-circuit, the dimming control sub-circuit is connected to the plurality of light-emitting diodes, and is configured to adjust brightnesses of the plurality of light-emitting diodes.

In the backlight driving circuit provided in the embodiment of the present disclosure, the dimming control sub-circuit comprises a plurality of field effect transistors, a plurality of resistors, and a dimming control chip, wherein, Drains of the plurality of field effect transistors are connected to the plurality of light-emitting diodes in a one-to-one correspondence, gates of the plurality of field effect transistors are all connected to the dimming control chip, and sources of the plurality of field effect transistors are connected to the plurality of resistors in one-to-one correspondence, and are also connected to the dimming control chip.

The present disclosure further provides a display device, wherein the display device comprises a backlight driving circuit mentioned above, and the backlight driving circuit comprises:

A backlight driving sub-circuit, comprising a power supply chip and a plurality of light-emitting diodes connected to the power supply chip, wherein the power supply chip is configured to provide working voltages to each of the plurality of light-emitting diodes;

A voltage protection sub-circuit connected to the plurality of light-emitting diodes and the power supply chip, wherein the voltage protection sub-circuit is configured to output a feedback signal to the power supply chip to stop the power supply chip from working when an output of the plurality of light-emitting diodes is detected to be abnormal.

In the display device provided in the embodiment of the present disclosure, the voltage protection sub-circuit comprises a voltage detection module, a voltage comparison module, and a voltage processing module, wherein, The voltage detection module is connected to the plurality of light-emitting diodes and the voltage comparison module, and the voltage detection module is configured to filter out the highest negative terminal voltage among the negative terminal voltages output by the plurality of light-emitting diodes, and to output the highest negative terminal voltage among the negative terminal voltages output by the plurality of light-emitting diodes to the voltage comparison module;

The voltage comparison module is connected to the voltage detection module and the voltage processing module, and the voltage comparison module is configured to compare the highest negative terminal voltage among the negative terminal voltages output by the plurality of light-emitting diodes with a preset voltage, and to output an abnormal signal to the voltage processing module when the highest negative terminal voltage among the negative terminal voltages output by the plurality of light-emitting diodes is greater than the preset voltage; and The voltage processing module is connected to the voltage comparison module and the power supply chip, and the voltage processing module is configured to output the feedback signal to the power supply chip according to the abnormal signal, in order to stop the power supply chip from working.

In the display device provided in the embodiment of the present disclosure, the voltage detection module comprises a plurality of diodes, anodes of the plurality of diodes are respectively connected to negative terminals of the plurality of light-emitting diodes in a one-to-one correspondence, and cathodes of the plurality of diodes are connected together and connected to an input terminal of the voltage comparison module.

In the display device provided in the embodiment of the present disclosure, the voltage comparison module comprises a comparator, a first input terminal of the comparator is connected to an output terminal of the voltage detection module, a second input terminal is connected with a preset voltage signal, and an output terminal of the comparator is connected to an input terminal of the voltage processing module.

In the display device provided in the embodiment of the present disclosure, a voltage of the preset voltage signal ranges from 3V to 6V.

In the display device provided in the embodiment of the present disclosure, the voltage processing module comprises a first resistor, a second resistor, a third resistor, a first triode, a second triode, and a voltage output unit, wherein, One terminal of the first resistor is connected to a collector of the second triode and an output terminal of the voltage comparison module, and the other terminal of the first resistor is connected to a base of the first triode;

One terminal of the second resistor is connected to an emitter of the second triode and the voltage output unit, the other terminal of the second resistor is connected to one terminal of the third resistor and a base of the second triode, and the other terminal of the third resistor is connected to a collector of the first triode and an input terminal of the power supply chip; and An emitter of the first triode is grounded.

In the display device provided in the embodiment of the present disclosure, when the voltage processing module receives the abnormal signal output by the voltage comparison module, the first triode is turned on;

A current flowing through the base of the second triode increases, and the second triode is turned on;

A voltage output by the voltage output unit is applied to the base of the first triode, the first triode is further turned on, and both the first triode and the second triode reach saturation conduction status; and The collector of the first triode maintains the state of outputting a low level to the power supply chip, so that the power supply chip stops working.

In the display device provided in the embodiment of the present disclosure, the backlight driving circuit further comprises a dimming control sub-circuit, the dimming control sub-circuit is connected to the plurality of light-emitting diodes, and is configured to adjust brightnesses of the plurality of light-emitting diodes.

In the display device provided in the embodiment of the present disclosure, the dimming control sub-circuit comprises a plurality of field effect transistors, a plurality of resistors, and a dimming control chip; wherein, Drains of the plurality of field effect transistors are connected to the plurality of light-emitting diodes in a one-to-one correspondence, gates of the plurality of field effect transistors are all connected to the dimming control chip, and sources of the plurality of field effect transistors are connected to the plurality of resistors in one-to-one correspondence, and are also connected to the dimming control chip.

Beneficial Effect

In the backlight driving circuit and display device provided in the present disclosure, by adding the voltage protection sub-circuit, when the negative terminal voltage of the light emitting diode is abnormal, the voltage protection sub-circuit will output the feedback signal to the power supply chip, so that the power supply chip stops working. When the power supply chip stops working, the light-emitting diodes cannot work either, and then the field effect transistors in the dimming control sub-circuit will not work, and thus, there will be no excessive temperature phenomenon, and it will not affect the reliability of the backlight driving circuit. Therefore, by adding the voltage protection sub-circuit in the backlight circuit, the technical problem that the reliability of the backlight driving circuit is affected by the abnormal voltage at the negative terminal of the light emitting diode can be solved.

DESCRIPTION OF DRAWINGS

The following describes specific implementations of the present disclosure in detail with reference to the accompanying drawings, which will make the technical solutions and other beneficial effects of the present disclosure obvious.

DETAILED DESCRIPTION OF PREFERRED EMBODIMENTS

Figure 1:
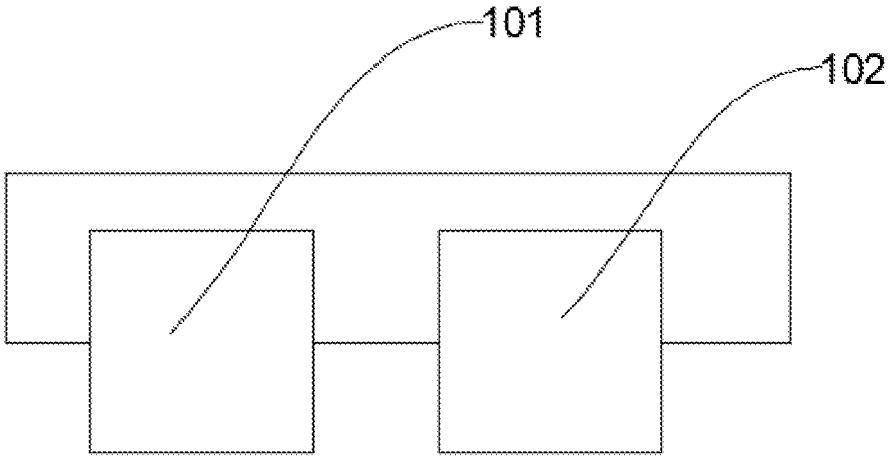
FIG. 1 is a schematic diagram of a first circuit of a backlight driving circuit provided in an embodiment of the present disclosure.

Technical solutions in embodiments of the present disclosure will be clearly and completely described below in conjunction with drawings in the embodiments of the present disclosure. It is clear that the described embodiments are part of embodiments of the present disclosure, but not all embodiments. Based on the embodiments of the present disclosure, all other embodiments to those of ordinary skill in the premise of no creative efforts obtained, should be considered within the scope of protection of the present disclosure.

The following description provides various embodiments or examples for implementing various structures of the present disclosure. To simplify the description of the present disclosure, parts and settings of specific examples are described as follows. Certainly, they are only illustrative, and are not intended to limit the present disclosure. Further, reference numerals and reference letters may be repeated in different examples. This repetition is for purposes of simplicity and clarity and does not indicate a relationship of the various embodiments and/or the settings. Furthermore, the present disclosure provides specific examples of various processes and materials, however, applications of other processes and/or other materials may be appreciated those skilled in the art.

Specifically, please refer to FIG. 1. FIG. 1 is a schematic diagram of a first circuit of a backlight driving circuit provided in an embodiment of the present disclosure. As shown in FIG. 1, the backlight driving circuit provided in the embodiment of the present disclosure comprises a backlight driving sub-circuit 101 and a voltage protection sub-circuit 102, wherein an output terminal of the backlight driving sub-circuit 101 is connected to an input terminal of the voltage protection sub-circuit 102, and an output terminal of the voltage protection sub-circuit 102 is connected to an input terminal of the backlight driving sub-circuit 101.

It can be understood that when a voltage of the backlight driving sub-circuit 101 is abnormal, the voltage protection sub-circuit 102 will output a feedback signal to the backlight driving sub-circuit 101, so that the backlight driving sub-circuit 101 stops working, thereby improving reliability of the backlight driving circuit.

Figure 2:
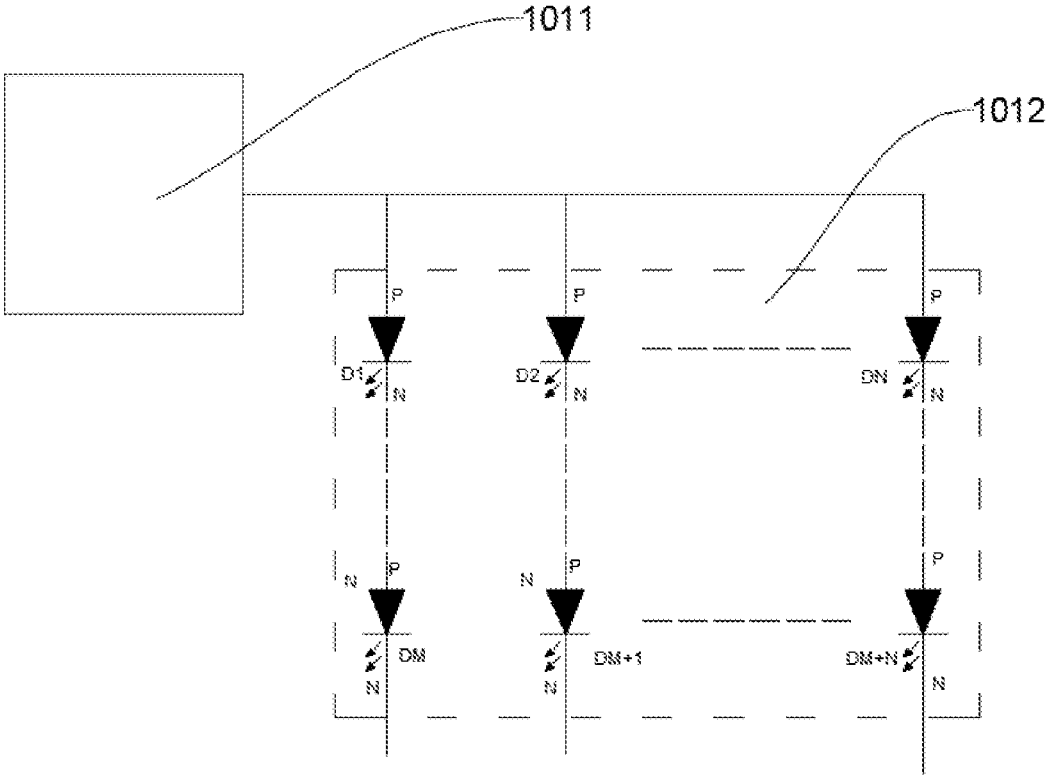
FIG. 2 is a schematic circuit diagram of a backlight driving sub-circuit provided in the embodiment of the present disclosure.

Specifically, please refer to FIG. 2. FIG. 2 is a schematic circuit diagram of the backlight driving sub-circuit provided in the embodiment of the present disclosure. As shown in FIG. 2, the backlight driving sub-circuit 101 provided in the embodiment of the present disclosure comprises a power supply chip 1011 and a plurality of light-emitting diodes 1012 connected to the power supply chip 1011, wherein the plurality of light-emitting diodes 1012 include light-emitting diodes D1 to DN and light-emitting diodes DM to DM+N.

It can be understood that the power supply chip 1011 is configured to provide working voltages to the light-emitting diodes D1 to DN, and the light-emitting diodes D1 to DN and the light-emitting diodes DM to DM+N are configured to provide backlight to a display panel.

Figure 3:
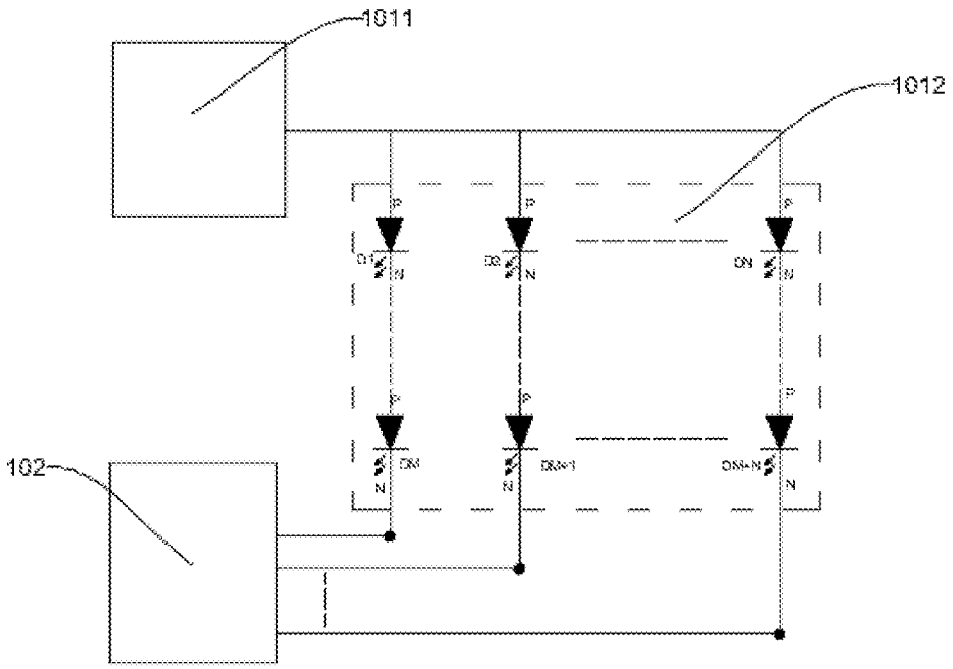
FIG. 3 is a schematic diagram of a second circuit of the backlight driving circuit provided in the embodiment of the present disclosure.

In addition, please refer to FIG. 3. FIG. 3 is a schematic diagram of a second circuit of the backlight driving circuit provided in the embodiment of the present disclosure. As shown in FIGS. 1 and 3, the backlight driving circuit provided in the embodiment of the present disclosure comprises the backlight driving sub-circuit 101 and the voltage protection sub-circuit 102. The backlight driving sub-circuit 101 comprises the power supply chip 1011 and the plurality of light-emitting diodes 1012 connected to the power supply chip 1011, wherein the plurality of light-emitting diodes 1012 include the light-emitting diodes D1 to DN and the light-emitting diodes DM to DM+N.

Wherein, the power supply chip 1011 is connected to the plurality of light-emitting diodes 1012 and configured to provide working voltages to the plurality of light-emitting diodes 1012.

Wherein, the voltage protection sub-circuit 102 is connected to a plurality of light-emitting diodes 1012 and the power supply chip 1011, and is configured to output a feedback signal to the power supply chip 101 when an abnormal output of the plurality of light-emitting diodes 1012 is detected, so that the power supply chip 101 stops working.

It can be understood that when a negative terminal voltage of the light emitting diode 1012 is abnormal, the voltage protection sub-circuit 102 will output a feedback signal to the power supply chip 1011, so that the power supply chip 1011 stops working, thereby improving the reliability of the backlight driving circuit.

Figure 4:
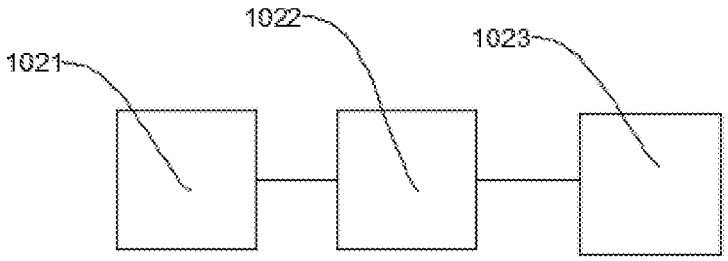
FIG. 4 is a schematic diagram of a first circuit of a voltage protection sub-circuit provided in the embodiment of the present disclosure.

In addition, please refer to FIGS. 3 and 4. FIG. 4 is a schematic diagram of a first circuit of the voltage protection sub-circuit provided in the embodiment of the present disclosure. As shown in FIG. 4, the voltage protection sub-circuit 102 provided in the embodiment of the present disclosure comprises a voltage detection module 1021, a voltage comparison module 1022, and a voltage processing module 1023.

Wherein, the voltage detection module 1021 is connected to the plurality of light-emitting diodes 1012 and the voltage comparison module 1022, and is configured to filter out the highest negative terminal voltage among the negative terminal voltages output by the plurality of light-emitting diodes 1012, and to detect the highest negative terminal voltage among the terminal voltages output to the voltage comparison module 1022.

Wherein, the voltage comparison module 1022 is connected to the voltage detection module 1021 and the voltage processing module 1023. The voltage comparison module 1022 is configured to compare the highest negative terminal voltage among the negative terminal voltages output by the plurality of light-emitting diodes 1012 with a preset voltage, and output an abnormal signal to the voltage processing module 1023 when the highest negative terminal voltage among the negative terminal voltages output by the plurality of light-emitting diodes 1012 is greater than the preset voltage.

Wherein, the voltage processing module 1023 is connected to the voltage comparison module 1022 and the power supply chip 1011. The voltage processing module 1023 is configured to output a feedback signal to the power supply chip 1011 according to the abnormal signal, so that the power supply chip 1011 stops working.

Figure 5:
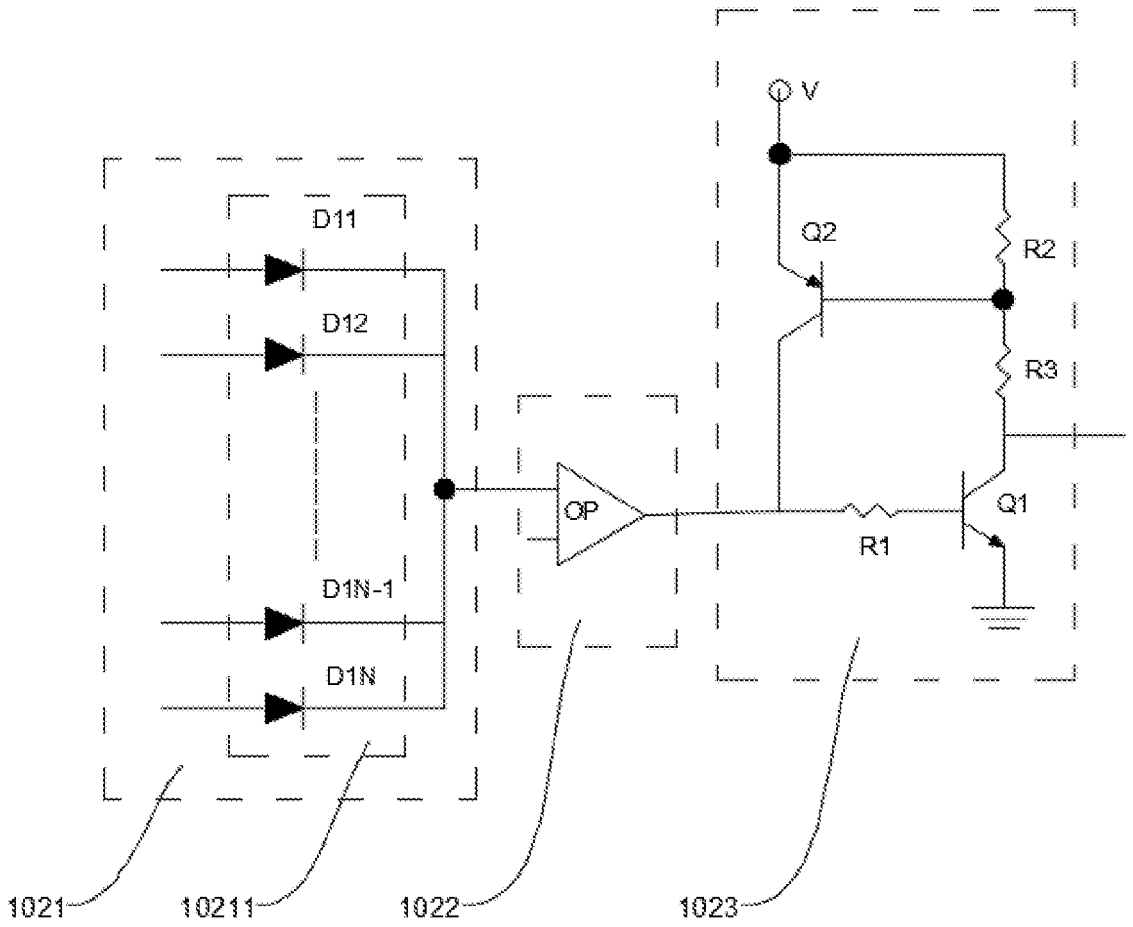
FIG. 5 is a schematic diagram of a second circuit of the voltage protection sub-circuit provided in the embodiment of the present disclosure.

Further, please refer to FIGS. 3 and 5. FIG. 5 is a schematic diagram of a second circuit of the voltage protection sub-circuit provided in the embodiment of the present disclosure. As shown in FIG. 5, the voltage protection sub-circuit 102 provided in the embodiment of the present disclosure comprises the voltage detection module 1021, the voltage comparison module 1022, and the voltage processing module 1023. Wherein the voltage detection module 1021 comprises a plurality of diodes 10211, and the plurality of diodes 10211 include diodes D11 to D1N. The voltage comparison module 1022 comprises a comparator OP, and the voltage processing module 1023 comprises a first resistor R1, a second resistor R2, a third resistor R3, a first triode Q1, a second triode Q2, and a voltage output unit V.

Wherein, anodes of the plurality of diodes 10211 are respectively connected to negative ends of the plurality of light-emitting diodes 1012 in a one-to-one correspondence, and cathodes of the plurality of diodes 10211 are connected together and are connected to an input terminal of the voltage comparison module 1022.

It can be understood that, due to clamping and blocking effect of the plurality of diodes 10211, the highest negative terminal voltage among the negative terminal voltages of the plurality of light-emitting diodes 1012 can be screened out, and the highest negative terminal voltage of the negative terminal voltages of plurality of light-emitting diodes 1012 is output to the voltage comparison module 1022.

It can be understood that, the highest negative terminal voltage among the negative terminal voltages of the plurality of light-emitting diodes 1012 obtained by the clamping and blocking action of the plurality of diodes 10211 is 0.6V less than the highest negative terminal voltage among actual negative terminal voltages of the plurality of light-emitting diodes 1012.

Wherein, a first input terminal of the comparator OP is connected to an output terminal of the voltage detection module 1021, and a second input terminal of the comparator OP is connected to a preset voltage signal, and an output terminal of the comparator OP is connected to an input terminal of the voltage processing module 1023.

Wherein, in one embodiment, a voltage of the preset voltage signal connected to the second input terminal of the comparator OP ranges from 3V to 6V. As for the specific setting, it is determined according to actual conditions.

It can be understood that, the comparator OP will compare a voltage transmitted from the voltage detection module 1021 with the preset voltage. When the voltage transmitted from the voltage detection module 1021 is greater than the preset voltage, an abnormal signal is output to the voltage processing module 1023, where the abnormal signal refers to an abnormal logic high level. When the voltage transmitted from the voltage detection module 1021 is less than or equal to the preset voltage, a normal signal is transmitted to the voltage processing module 1023, and the normal signal refers to a normal logic low level.

Wherein, one terminal of the first resistor R1 is connected to a collector of the second triode Q2 and the output terminal of the voltage comparison module 1022, and the other terminal of the first resistor R1 is connected to a base of the first triode Q1. One terminal of the second resistor R2 is connected to an emitter of the second triode Q2 and the voltage output unit V, the other terminal of the second resistor R2 is connected to one terminal of the third resistor R3 and a base of the second triode Q2, and the other terminal of the third resistor R3 is connected to a collector of the first triode Q1 and an input terminal of the power supply chip 1011. An emitter of the first triode Q1 is grounded.

It can be understood that when the voltage processing module 1023 receives the normal logic low level transmitted from the voltage comparison module 1022, the first triode Q1 remains in turn off state, and the voltage output unit V uses the second resistor R2 and the third resistor R3 as loads and outputs a logic high level to the power supply chip 1011, so that the power supply chip 1011 maintains the state of outputting the power supply voltage to the light-emitting diodes 1012.

It can be understood that when the voltage processing module 1023 receives the abnormal logic high level transmitted from the voltage comparison module 1022, the first triode Q1 is turned on. Since the emitter of the first triode Q1 is grounded, the collector of the first triode Q1 pulls the voltage of the power supply chip 1011 down to the ground, so that the power supply chip 1011 stops working. Then, a current flowing through the base of the second triode Q2 becomes larger, the second triode Q2 is turned on, and the voltage output by the voltage output unit V is applied to the base of the first transistor Q1. The triode Q1 is further turned on, and both the first triode Q1 and the second triode Q2 reach the saturated conduction state. The collector of the first triode Q1 maintains the state of outputting low level to the power supply chip 1011, so that the power supply chip 1011 completely stops working, and the power supply chip 1011 maintains the state of stopping working when the voltage output unit V is not disconnected.

Figure 6:
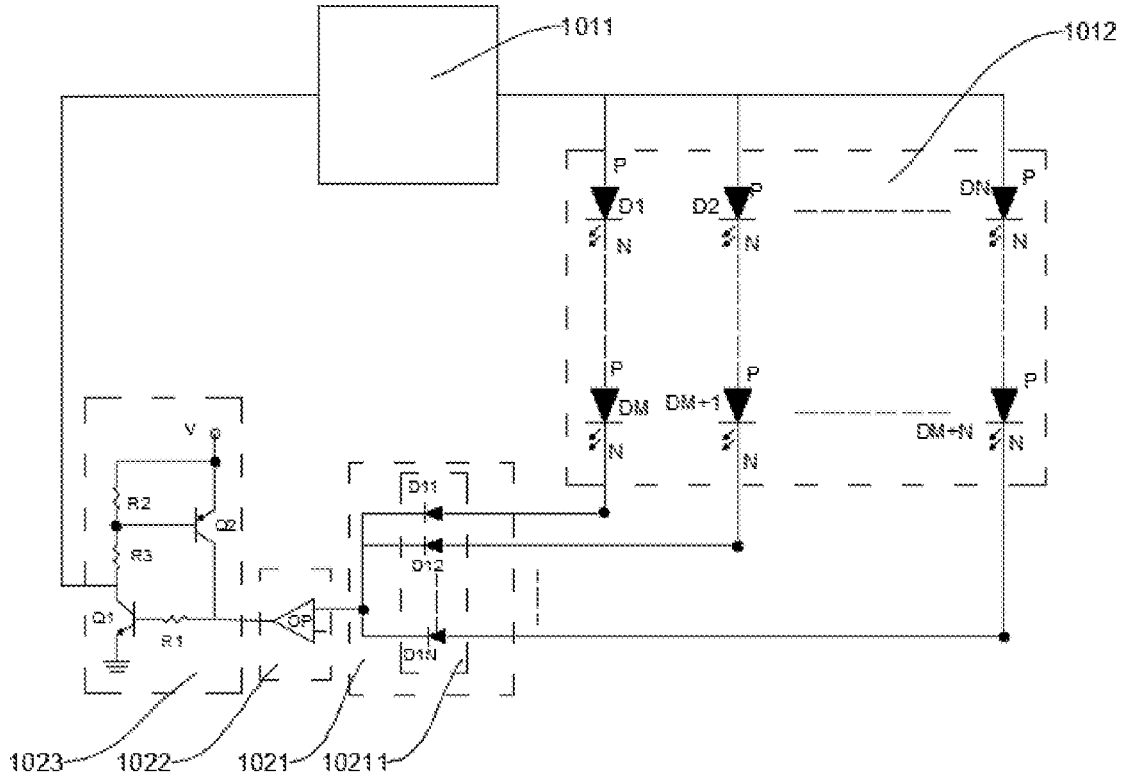
FIG. 6 is a schematic diagram of a third circuit of the backlight driving circuit provided in the embodiment of the present disclosure.

Further, please refer to FIG. 6. FIG. 6 is a schematic diagram of a third circuit of the backlight driving circuit provided in the embodiment of the present disclosure. As shown in FIGS. 1 and 6, the backlight driving circuit provided in the embodiment of the present disclosure comprises the backlight driving sub-circuit 101 and the voltage protection sub-circuit 102.

Wherein, the backlight driving sub-circuit 101 comprises the power supply chip 1011 and the plurality of light-emitting diodes 1012 connected to the power supply chip 1011. The plurality of light-emitting diodes 1012 include light emitting diodes D1 to DN and light emitting diodes DM to DM+N.

The voltage protection sub-circuit 102 comprises the voltage detection module 1021, the voltage comparison module 1022, and the voltage processing module 1023. The voltage detection module 1021 comprises the plurality of diodes 10211, and the plurality of diodes 10211 include diodes D11 to D1N. The voltage comparison module 1022 comprises the comparator OP. The voltage processing module 1023 comprises the first resistor R1, the second resistor R2, the third resistor R3, the first triode Q1, the second triode Q2, and the voltage output unit V.

It can be understood that when the highest negative terminal voltage of the negative terminal voltages of the light-emitting diodes 1012 is greater than the preset voltage, the voltage protection sub-circuit 102 will output a logic low level to the power supply chip 1011, so that the power supply chip 1011 stops working. When the power supply chip 1011 stops working, the light-emitting diode 1012 cannot work, thereby improving the reliability of the backlight driving circuit.

In one embodiment, the voltage output by the voltage output unit V ranges from 3V to 6V. As for the specific setting, it is determined according to actual conditions.

Figure 7:
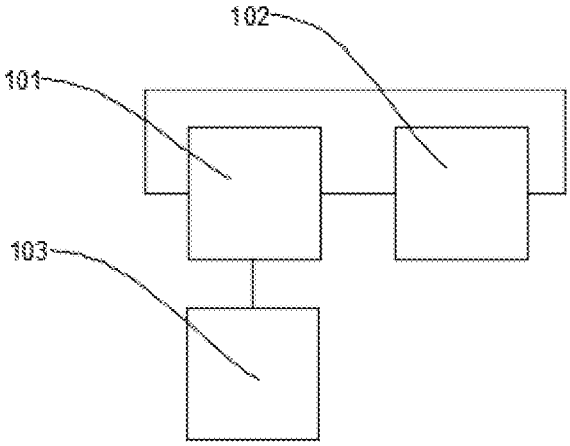
FIG. 7 is a schematic diagram of a fourth circuit of the backlight driving circuit provided in the embodiment of the present disclosure.

Specifically, please refer to FIG. 7. FIG. 7 is a schematic diagram of a fourth circuit of the backlight driving circuit provided in the embodiment of the present disclosure. As shown in FIG. 7, the backlight driving circuit provided in the embodiment of the present disclosure comprises the backlight driving sub-circuit 101, the voltage protection sub-circuit 102, and a dimming control sub-circuit 103.

Wherein, the output terminal of the backlight driving sub-circuit 101 is connected to the input terminal of the voltage protection sub-circuit 102, the output terminal of the voltage protection sub-circuit 102 is connected to the input terminal of the backlight driving sub-circuit 101, and the dimming control sub-circuit 103 is connected to the backlight control sub-circuit 101.

It can be understood that when the voltage of the backlight driving sub-circuit 101 is abnormal, the voltage protection sub-circuit 102 will output a feedback signal to the backlight driving sub-circuit 101, so that the backlight driving sub-circuit 101 stops working, and the dimming control sub-circuit 103 will not be abnormal due to the abnormality of the backlight driving sub-circuit 101, thereby improving the reliability of the backlight driving circuit.

Figure 8:
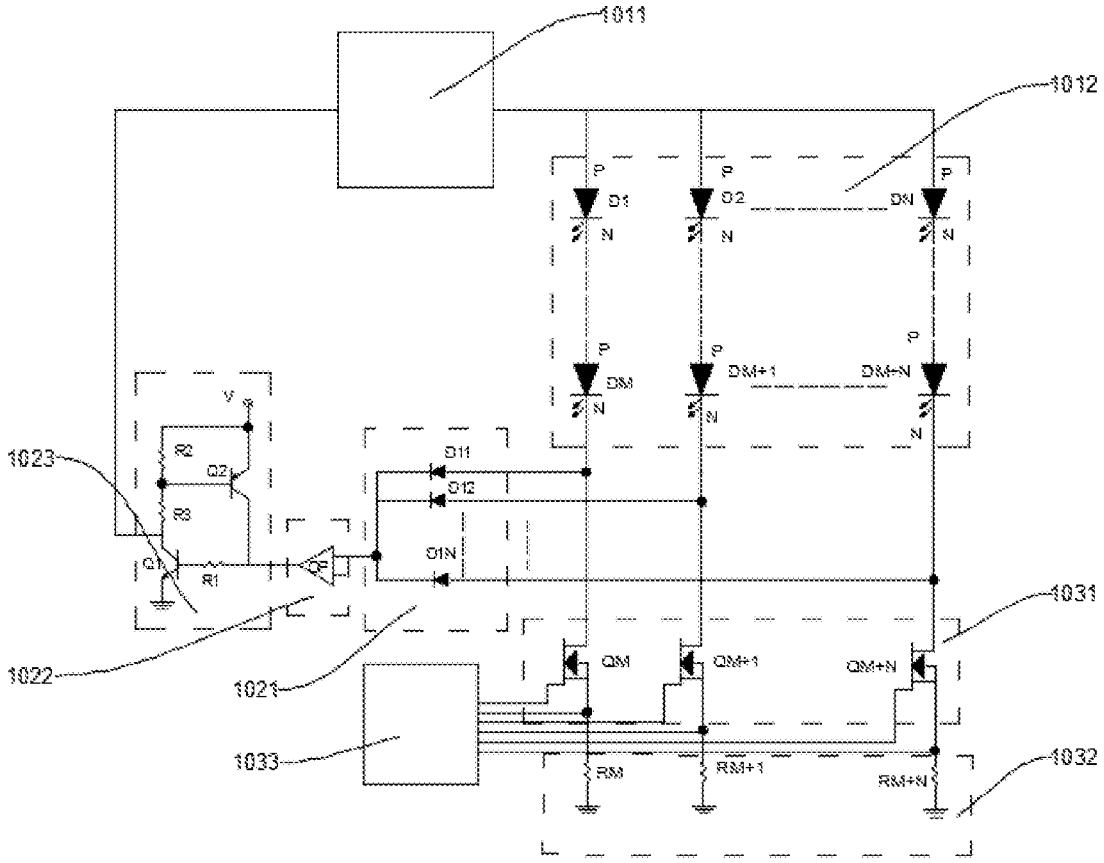
FIG. 8 is a schematic diagram of a fifth circuit of the backlight driving circuit provided in the embodiment of the present disclosure.

Specifically, please refer to FIG. 8. FIG. 8 is a schematic diagram of a fifth circuit of the backlight driving circuit provided in the embodiment of the present disclosure. As shown in FIGS. 7 and 8, the backlight driving circuit provided in the embodiment of the present disclosure comprises the backlight driving sub-circuit 101, the voltage protection sub-circuit 102, and the dimming control sub-circuit 103.

Wherein, the backlight driving sub-circuit 101 comprises the power supply chip 1011 and the plurality of light-emitting diodes 1012 connected to the power supply chip 1011. The plurality of light-emitting diodes 1012 include light emitting diodes D1 to DN and light emitting diodes DM to DM+N.

The voltage protection sub-circuit 102 comprises the voltage detection module 1021, the voltage comparison module 1022, and the voltage processing module 1023. The voltage detection module 1021 includes the plurality of diodes 10211, and the plurality of diodes 10211 include diodes D11 to D1N. The voltage comparison module 1022 comprises the comparator OP. The voltage processing module 1023 comprises the first resistor R1, the second resistor R2, the third resistor R3, the first triode Q1, the second triode Q2, and the voltage output unit V.

The dimming control sub-circuit 103 comprises a plurality of field effect transistors 1031, a plurality of resistors 1032, and a dimming control chip 1033. The plurality of field effect transistors 1031 include field effect transistors QM to QM+N, and the plurality of resistors include resistors RM to RM+N.

Gates of the plurality of field effect transistors 1031 are all connected to the dimming control chip 1033, sources of the plurality of field effect transistors 1031 are connected to the plurality of resistors 1032 in a one-to-one correspondence, and the sources of the plurality of field effect transistors 1031 are also connected to the dimming control chip 1033. The dimming control chip 1033 adjusts currents flowing in the plurality of light-emitting diodes 1012 through the plurality of resistors 1032 and the plurality of field effect transistors 1031, thereby changing brightnesses of the plurality of light-emitting diodes 1012.

It can be understood that when the negative terminal voltages of the light-emitting diodes 1012 are too high, the dimming control chip 1033 adjusts the currents flowing into the plurality of light-emitting diodes 1012 through the plurality of resistors 1032 and the plurality of field effect transistors 1031. When changing the brightnesses of the plurality of light-emitting diodes 1012, the temperatures of the plurality of field effect transistors 1031 increase, so the dimming control sub-circuit 103 will be damaged when the temperatures of the plurality of field effect transistors 1031 reach a certain level. Therefore, the negative terminal voltages of the light-emitting diodes 1012 need to be controlled.

It can be understood that when the highest negative terminal voltage of the negative terminal voltages of the light-emitting diodes 1012 is greater than the preset voltage, the voltage protection sub-circuit 102 will output a logic low level to the power supply chip 1011, so that the power supply chip 1011 stops working. Therefore, the temperatures of the field effect transistors 1031 will not rise due to the excessively high negative terminal voltage of the light-emitting diode 1012, thereby improving the reliability of the backlight driving circuit.

In the backlight driving circuit provided in the present disclosure, by adding the voltage protection sub-circuit, when the negative terminal voltage of the light-emitting diode is abnormal, the voltage protection sub-circuit will output the feedback signal to the power supply chip, so that the power supply chip stops working. When the power supply chip stops working, the light-emitting diodes will not work, and the filed effect transistors in the dimming control sub-circuit will not work either, thus, the temperature will not be too high, and it will not affect the reliability of the backlight driving circuit. Therefore, by adding the voltage protection sub-circuit in the backlight circuit, the technical problem that the reliability of the backlight driving circuit is affected by the abnormal voltage of the negative terminal of the light emitting diode can be solved.

The present disclosure also provides a display device, wherein the display device comprises the backlight driving circuit described in the above-mentioned embodiments. Since the backlight driving circuit has been described in detail in the above-mentioned embodiments, it will not be repeated here.

In the display device provided in the present disclosure, the voltage protection sub-circuit is added to the backlight driving circuit of the display device. When the negative terminal voltage of the light emitting diode is abnormal, the voltage protection sub-circuit will output the feedback signal to the power supply chip, so that the power supply chip stops working. When the power supply chip stops working, the light-emitting diodes will not work, and the filed effect transistors in the dimming control sub-circuit will not work, thus the temperature will not be too high and it will not affect the reliability of the backlight driving circuit, and thereby improving the reliability of the display device.

In the above-mentioned embodiments, the description of each embodiment has its own focus. For parts that are not described in detail in an embodiment, reference may be made to related descriptions of other embodiments.

The above provides a detailed introduction to the backlight driving circuit and the display device provided in the embodiments of the present disclosure. Specific examples are configured in this article to illustrate the principles and implementations of the present disclosure. The description of the above embodiments is only for help to understand the technical solution of the present disclosure and its core ideas; those of ordinary skill in the art should understand that, they can still modify the technical solutions recorded in the foregoing embodiments, or equivalently replace some of the technical features; and these modifications or replacements do not cause the essence of the corresponding technical solutions to deviate from the scope of the technical solutions of the embodiments of the present disclosure.

What is claimed is:

1. A backlight driving circuit, comprising:

a backlight driving sub-circuit, comprising a power supply chip and a plurality of light-emitting diodes connected to the power supply chip, wherein the power supply chip is configured to provide working voltages to each of the plurality of light-emitting diodes; and a voltage protection sub-circuit connected to the plurality of light-emitting diodes and the power supply chip, wherein the voltage protection sub-circuit is configured to output a feedback signal to the power supply chip to stop the power supply chip from working when an output of the plurality of light-emitting diodes is detected to be abnormal, wherein the voltage protection sub-circuit comprises a voltage detection module, a voltage comparison module, and a voltage processing module, wherein the voltage detection module is connected to the plurality of light-emitting diodes and the voltage comparison module, and the voltage detection module is configured to filter out a highest negative terminal voltage among negative terminal voltages output by the plurality of light-emitting diodes, and to output the highest negative terminal voltage among the negative terminal voltages output by the plurality of light-emitting diodes to the voltage comparison module;

the voltage comparison module is connected to the voltage detection module and the voltage processing module, and the voltage comparison module is configured to compare the highest negative terminal voltage among the negative terminal voltages output by the plurality of light-emitting diodes with a preset voltage, and to output an abnormal signal to the voltage processing module when the highest negative terminal voltage among the negative terminal voltages output by the plurality of light-emitting diodes is greater than the preset voltage; and the voltage processing module is connected to the voltage comparison module and the power supply chip, and the voltage processing module is configured to output the feedback signal to the power supply chip according to the abnormal signal, in order to stop the power supply chip from working, and wherein the voltage processing module comprises a first resistor, a second resistor, a third resistor, a first triode, a second triode, and a voltage output unit, wherein, one terminal of the first resistor is connected to a collector of the second triode and an output terminal of the voltage comparison module, and another terminal of the first resistor is connected to a base of the first triode;

one terminal of the second resistor is connected to an emitter of the second triode and the voltage output unit, another terminal of the second resistor is connected to one terminal of the third resistor and a base of the second triode, and another terminal of the third resistor is connected to a collector of the first triode and an input terminal of the power supply chip; and an emitter of the first triode is grounded.

2. The backlight driving circuit of claim 1, wherein the voltage detection module comprises a plurality of diodes, anodes of the plurality of diodes are respectively connected to negative terminals of the plurality of light-emitting diodes in a one-to-one correspondence, and cathodes of the plurality of diodes are connected together and connected to an input terminal of the voltage comparison module.

3. The backlight driving circuit of claim 1, wherein the voltage comparison module comprises a comparator, a first input terminal of the comparator is connected to an output terminal of the voltage detection module, a second input terminal is connected with a preset voltage signal, and an output terminal of the comparator is connected to an input terminal of the voltage processing module.

4. The backlight driving circuit of claim 3, wherein a voltage of the preset voltage signal ranges from 3V to 6V.

5. The backlight driving circuit of claim 1, wherein when the voltage processing module receives the abnormal signal output by the voltage comparison module, the first triode is turned on;

a current flowing through the base of the second triode increases, and the second triode is turned on;

a voltage output by the voltage output unit is applied to the base of the first triode, the first triode is further turned on, and both the first triode and the second triode reach saturation conduction status; and the collector of the first triode maintains a state of outputting a low level to the power supply chip, so that the power supply chip stops working.

6. The backlight driving circuit of claim 1, wherein the backlight driving circuit further comprises a dimming control sub-circuit, the dimming control sub-circuit is connected to the plurality of light-emitting diodes, and is configured to adjust brightnesses of the plurality of light-emitting diodes.

7. The backlight driving circuit of claim 6, wherein the dimming control sub-circuit comprises a plurality of field effect transistors, a plurality of resistors, and a dimming control chip; wherein, drains of the plurality of field effect transistors are connected to the plurality of light-emitting diodes in a one-to-one correspondence, gates of the plurality of field effect transistors are all connected to the dimming control chip, and sources of the plurality of field effect transistors are connected to the plurality of resistors in one-to-one correspondence, and are also connected to the dimming control chip.

8. A display device, wherein the display device comprises a backlight driving circuit, and the backlight driving circuit comprises:

a backlight driving sub-circuit, comprising a power supply chip and a plurality of light-emitting diodes connected to the power supply chip, wherein the power supply chip is configured to provide working voltages to each of the plurality of light-emitting diodes; and a voltage protection sub-circuit connected to the plurality of light-emitting diodes and the power supply chip, wherein the voltage protection sub-circuit is configured to output a feedback signal to the power supply chip to stop the power supply chip from working when an output of the plurality of light-emitting diodes is detected to be abnormal, wherein the voltage protection sub-circuit comprises a voltage detection module, a voltage comparison module, and a voltage processing module, wherein, the voltage detection module is connected to the plurality of light-emitting diodes and the voltage comparison module, and the voltage detection module is configured to filter out a highest negative terminal voltage among negative terminal voltages output by the plurality of light-emitting diodes, and to output the highest negative terminal voltage among the negative terminal voltages output by the plurality of light-emitting diodes to the voltage comparison module;

the voltage comparison module is connected to the voltage detection module and the voltage processing module, and the voltage comparison module is configured to compare the highest negative terminal voltage among the negative terminal voltages output by the plurality of light-emitting diodes with a preset voltage, and to output an abnormal signal to the voltage processing module when the highest negative terminal voltage among the negative terminal voltages output by the plurality of light-emitting diodes is greater than the preset voltage; and the voltage processing module is connected to the voltage comparison module and the power supply chip, and the voltage processing module is configured to output the feedback signal to the power supply chip according to the abnormal signal, in order to stop the power supply chip from working, wherein the voltage processing module comprises a first resistor, a second resistor, a third resistor, a first triode, a second triode, and a voltage output unit, wherein, one terminal of the first resistor is connected to a collector of the second triode and an output terminal of the voltage comparison module, and another terminal of the first resistor is connected to a base of the first triode;

one terminal of the second resistor is connected to an emitter of the second triode and the voltage output unit, another terminal of the second resistor is connected to one terminal of the third resistor and a base of the second triode, and another terminal of the third resistor is connected to a collector of the first triode and an input terminal of the power supply chip; and an emitter of the first triode is grounded.

9. The display device of claim 8, wherein the voltage detection module comprises a plurality of diodes, anodes of the plurality of diodes are respectively connected to negative terminals of the plurality of light-emitting diodes in a one-to-one correspondence, and cathodes of the plurality of diodes are connected together and connected to an input terminal of the voltage comparison module.

10. The display device of claim 8, wherein the voltage comparison module comprises a comparator, a first input terminal of the comparator is connected to an output terminal of the voltage detection module, a second input terminal is connected with a preset voltage signal, and an output terminal of the comparator is connected to an input terminal of the voltage processing module.

11. The display device of claim 10, wherein a voltage of the preset voltage signal ranges from 3V to 6V.

12. The display device of claim 8, wherein when the voltage processing module receives the abnormal signal output by the voltage comparison module, the first triode is turned on;

a current flowing through the base of the second triode increases, and the second triode is turned on;

a voltage output by the voltage output unit is applied to the base of the first triode, the first triode is further turned on, and both the first triode and the second triode reach saturation conduction status; and the collector of the first triode maintains a state of outputting a low level to the power supply chip, so that the power supply chip stops working.

13. The display device of claim 8, wherein the backlight driving circuit further comprises a dimming control sub-circuit, the dimming control sub-circuit is connected to the plurality of light-emitting diodes, and is configured to adjust brightnesses of the plurality of light-emitting diodes.

14. The display device of claim 13, wherein the dimming control sub-circuit comprises a plurality of field effect transistors, a plurality of resistors, and a dimming control chip; wherein, drains of the plurality of field effect transistors are connected to the plurality of light-emitting diodes in a one-to-one correspondence, gates of the plurality of field effect transistors are all connected to the dimming control chip, and sources of the plurality of field effect transistors are connected to the plurality of resistors in one-to-one correspondence, and are also connected to the dimming control chip.

* * * * *